United States Patent [19]

Berni et al.

[11] 4,092,106

[45] May 30, 1978

[54] EMULSION SYSTEMS FOR IMPARTING DURABLE PRESS PROPERTIES TO COTTON AND COTTON-POLYESTER BLENDED TEXTILES

[75] Inventors: Ralph J. Berni, Metairie; Ruth R. Benerito, New Orleans, both of La.; Mary W. Pilkington, Texarkana, Tex.

[73] Assignee: The United States of America as represented by the Secretary of Agriculture, Washington, D.C.

[21] Appl. No.: 725,225

[22] Filed: Sep. 22, 1976

Related U.S. Application Data

[63] Continuation of Ser. No. 578,299, May 16, 1975, abandoned.

[51] Int. Cl.[2] ..... D06M 13/08

[52] U.S. Cl. ..... 8/115.7; 8/185; 427/390 C; 427/392

[58] Field of Search ..... 260/29.4 R; 8/185, 115.6, 8/115.7, 116.2, 116.3; 427/392, 390 C

[56] References Cited

U.S. PATENT DOCUMENTS

| | | | |
|---|---|---|---|
| 3,455,642 | 7/1969 | Solomon | 8/115.6 |
| 3,565,846 | 2/1971 | Enders et al. | 260/29.4 |
| 3,617,194 | 11/1971 | Bannister et al. | 427/390 X |
| 3,617,195 | 11/1971 | Moyer et al. | 427/390 X |
| 3,658,717 | 4/1972 | Graff | 252/355 |

*Primary Examiner*—Michael R. Lusignan
*Attorney, Agent, or Firm*—M. Howard Silverstein; David G. McConnell; Salvador J. Cangemi

[57] ABSTRACT

Cotton and cotton-blended fabrics are impregnated with an emulsion containing an N-methylolated urea resin, a Lewis-acid catalyst, an emulsifying agent, and softener in a water-chlorinated solvent formulation to impart improved durable press properties.

9 Claims, No Drawings

EMULSION SYSTEMS FOR IMPARTING DURABLE PRESS PROPERTIES TO COTTON AND COTTON-POLYESTER BLENDED TEXTILES

This is a continuation, of application Ser. No. 578,299, filed May 16, 1975, now abandoned.

This invention relates to an improved emulsion system for N-methylolated ureas. More specifically, this invention relates to the finishing of cotton and cotton-blended textiles with emulsions containing certain N-methylolated urea resins, an acid catalyst, and a preferred emulsifying agent to provide improved durable press properties. These emulsions would be very useful in textile finishing installations.

The main object of the present invention is to provide an improved emulsion system which is stable. The system would be employed in finishng cotton-blended textiles in conjunction with certain finishing agents. The objective is achieved by being selective in the coice of emulsifying agents in combination with the preferred N-methylolated ureas.

Prior art processes are known, utilizing these same N-methylol reagents and catalysts in all aqueous treatments or their methyl ether derivatives in all chlorinated hydrocarbon solvents. The processes of the prior art are limited on the one hand by lack of solubility of some agents in water, and on the other hand by difficulties of preparing methyl ether derivatives of N-methylol reagents and further the sluggishness of the reactions of the methyl ethers dissolved in non-aqueous solvents with cellulose hydroxyls. Emulsions have been employed in the prior art but with limited success in imparting durable press properties to the textiles of this invention. U.S. Pat. No. 3,784,355 employed "an emulsion of the finishing agent in an organic solvent," then treated "the substrate with steam for a time sufficient to remove a major portion of the organic solvent . . . " It has become obvious now that the standards for high quality durable press fabric were not achieved, as evidenced by the dry crease recovery value of 260°, wet crease recovery of 220°, and durable press ratings of 3, after 5 washings (spin line dry rating) reported in col. 6, lines 11–12.

On the other hand, by utilizing the emulsion system of the present invention, improved values were attained, as evidenced by the dry crease recovery value of 282°, wet crease recovery of 281°, and durable press rating of 4.5, after 5 home launderings. These results were attained by using the emulsions systems which contain certain preferred emulsifying agents, and which provide stable emulsions.

The present invention offers the distinct advantage of using commerically available 45–50% aqueous stock solutions to prepare resin precondensates along with aqueous solutions of commerically available catalysts which can be emulsified in the chlorinated hydrocarbon solvents. A further advantage is the addition of any number of hydrocarbon soluble reagents, such as fluorochemicals, and certain dyestuffs, and the like, and thus permit a single application in fabric finishing. The water content of the emulsions of this invention of from 10% to 30% are particularly advantageous for proper impregnating, swelling, and conditioned and wet crosslinking of the cellulose materials.

With reference to the advantage in using the stable emulsions of the present invention it should be noted that these emulsions can be employed with excellent results in delayed cure processes for the manufacture of durable press garments wherein the fabrics are impregnated with the emulsion, the garments manufactured, and the curing delayed.

Briefly stating the spirit of the present invention, it can best be described as being an improved emulsion system for imparting high quality durable press properties to cotton and cotton-polyester blended textiles of the type containing a water solube N-methylol urea resin, about from 10% to 30% water, a chlorinated solvent, and a Lewis acid catalyst; wherein the improvement comprises adding about from 1% to 3% of an emulsifying agent selected from the group consisting of vinyl phenyl polyethylene glycol ether (nonionic), the sodium sulfate derivative of 3,9-diethyltridecanol-6 (anionic), the sodium sulfate derivative of 7-ethyl-2-methyl,4-undecanol, sodium lauryl sulfate, and a hydrocarbon-sodium sulfonate dry cleaning soap.

LIMITATIONS The resin precondensates applicable to the formulations of this invention are N-methylolated cyclic ureas or melamines capable of reacting and/or crosslinking with cotton cellulose hydroxyl groups in the presence of Lewis acid catalysts. N-methylolated compounds suitable for use in the process of the present invention include formaldehyde precondensates with urea, ethylene urea, propylene urea, dihydroxyethylene urea, ethyl-, methyl-, or hydroxyethyl carbamates, aminotriazines and the like.

Halogenated hydrocarbon solvents which may be used in the process of the present invention include any of the commerically available chlorinated hydrocarbons sufficiently volatile to be easily removed from the fabric and easily recycled for further use. Particularly suitable solvents include perchloroethylene, trichloroethylene, trichloroethane, and 1,1,1-trichloroethane.

Suitable catalysts in the present invention include organic acids such as monochloroacetic or trichloroacetic acid, amine hydrochlorides, as well as Lewis acid salts, such as zinc nitrate, magnesium chloride, and zinc fluoborate.

Suitable emulsifying agents in the present process include a vinyl phenyl polyethylene glycol ether (nonionic), the sodium sulfate derivative of 3,9-diethyltridecanol-6 (anionic), the sodium sulfate derivative of 7-ethyl-2-methyl,4-undecanol, sodium lauryl sulfate, or any of a number of hydrocarbon-sodium sulfonate soaps, or dry cleaning soaps.

A dry cleaning soap typically consists of a mixture of about from 20% to 50% of dodecylbenzene sulphonate, 5% to 15% of nonylphenolpolyglycol ether and 2% to 6% of a fatty alcohol ethoxylate in 2% to 4% mineral oil, 10% to 12% perchloroethylene, and 10% to 20% water.

The following examples are provided to illustrate the invention in its preferred embodiments.

EXAMPLE 1

Cotton-polyester (50/50) blended sheeting weighing 10.5 g was twice padded to 100–110% wet pickup with an emulsion containing the following:

83.9% (135.7 g) perchloroethylene
4.3% (7.0 g) dimethyloldihydroxyethylene urea (DMDHEU) (added as 14.0 g of 50% DMDHEU)
8.5% (13.8 g) water
0.4% (0.7 g) $MgCl_2$
1.0% (1.6 g) commercial softener (Velvotol-OE)

1.9% (3.0 g) emulsifying agent, a drycleaning charged soap (Terpuran extra)

The fabric was then dried in a forced draft oven at 60° C for 7 minutes, then cured at 160° C for 3 minutes. The fabric had a weight add-on of 2.3%, a conditioned (dry) wrinkle recovery of 282° and wet wrinkle recovery of 281° (warp plus fill), breaking strength of 76.0 pounds, a nitrogen content of 0.5%, and a formaldehyde content of 1.1%. The emulsion remained stable throughout the padding operation which is crucial to obtaining good resin migration in the treatment system. Permanent press ratings after 5 home launderings were better than 4.5. (Control values for the 50/50 cotton/polyester before treatment were dry recovery 259° and wet recovery 246° (W+F), respectively, breaking strength 94.3 pounds with no measurable nitrogen and formaldehyde. Permanent press ratings after 5 home launderings were 2.0.)

EXAMPLE 2

This example is provided to show that acceptable properites can be obtained when samples are stored after the drying step.

Cotton-polyester (50/50) blended sheeting was treated as in Example 1 with the exception that after the drying step, the sample was stored in a polyethylene bag for 60 days, removed, then cured at 160° C for 3 minutes. Fabric properties were as follows: Dry (conditioned) wrinkle recovery 287° and wet wrinkle recovery 273° (W+F), respectively, breaking strength 74.6 pounds and permanent press ratings after 5 home launderings were 4.5.

EXAMPLE 3

The following example is another preferred method of treatment using superheated steam drying for efficient recycling of solvent.

Cotton/polyester (50/50) blend sheeting was treated as in Example 1 with modification to the treating solution as follows:

68.7% (147.8 g) perchloroethylene 14.1% (30.4 g) DMDHEU (50% solution)

14.0% (30 g) $H_2O$ 1.5% (3.2 g) Emulsifying agent, a dry-cleaning charged soap (Terpuran Extra)

0.7% (1.6 g) $MgCl_2$ 0.9% (2.0 g) Commercial softener (Velvotol-OE)

Fabric was dried (after padding) at 105° C for 5 minutes using superheated steam. Fabrics were cured immediately or after 44 days delay in a polyethylene bag. Results are shown in the following table.

| Cotton in Blend % | Cure (160° C) | Nitrogen (%) | Formaldehyde (%) | Wrinkle Recovery (W+F) Dry | Wrinkle Recovery (W+F) Wet | Breaking Strength % | Elong. (%) | Durable Press Rating |
|---|---|---|---|---|---|---|---|---|
| 50 | none | 1.0 | 1.1 | 246 | 260 | 100 | 18.9 | 1.9 |
| 50 | I[a] | 1.1 | 1.4 | 295 | 283 | 74 | 23.8 | 4.3 |
| 50 | D[b] | 1.0 | 1.4 | 290 | 284 | 73 | 24.4 | 4.3 |

[a]Cured immediately (I)
[b]Curing delayed 44 days (D)

TEXTILE TESTING

All fabrics which were treated by the process of the present invention and their appropriate controls were subjected to standard testing as is customary with all researched textiles at the Southern Regional Research Center, the laboratories in New Orleans, Louisiana. The breaking strength evaluations were by the strip method (80-thread count) on a Scott Tester; conditioned (dry) wrinkle recovery angles by the Monsanto Method, with a 500 g weight; abrasion resistance by the Stoll flex method; wet wrinkle recovery angles as recommended by Fujimoto, Reinhardt, and Reid in American Dyestuff Reporter 52; pp 329–336 (1936). Wash-wear appearance ratings were performed after five home launderings with tumble dryings as in AATCC Test 124–73.

SUMMARY OF THE INVENTION

In brief, the present invention can best be described as an improved emulsion system for imparting durable press properties to cotton and cottonpolyester blended textiles containing about from 4 to 11% of an N-methylolated urea resin, about from 0.4 to 1.5% of a Lewis acid catalyst, about from 1% to 3% of an emulsifying agent, about 1% of a softener emulsified in about from 10% to 30% water, and about from 51% to 84% chlorinated solvent, to a wet pickup of about from 75% to 110%; drying the wet impregnated fabric in either superheated steam (about 105° C) for about from 5 to 10 minutes at a temperature of about from 140° to 180° C; and curing the impregnated fabric thereafter either immediately or after storage of about 60 days, for about 3 minutes at about 160° C.

We claim:

1. A method for imparting durable press properties to cotton and cotton-polyester blended textiles comprising the steps of:

(a) preparing an emulsion containing a durable press imparting amount of water soluble N-methylol urea resin, about from 10% to 30% water by weight, a chlorinated hydrocarbon solvent sufficiently volatile to be easily removed from the textile product resulting from the method, a Lewis acid catalyst and about from 1% to 3% by weight of an emulsifying agent selected from the group consisting of vinyl phenyl polyethylene glycol ether, sodium sulfate derivative of 3,9-diethyl-tridecanol-6, sodium sulfate derivative of 7-ethyl-2-methyl-4-undecanol, sodium lauryl sulfate, and hydrocarbon-sodium sulfonate dry cleaning soap;

(b) padding a cotton or cotton-polyester blended textile with the emulsion resulting from step (a) to a 100 to 110% wet pick-up by weight;

(c) drying and curing the padded textile resulting from step (b).

2. A method as described in claim 1 wherein the chlorinated hydrocarbon is selected from the group consisting of perchloroethylene, trichloroethylene, trichloroethane, and 1,1,1-trichloroethane.

3. A method as described in claim 1, wherein the emulsifying agent is vinyl phenyl polyethylene glycol ether.

4. A method as described in claim 1 wherein the emulsifying agent is a sodium sulfate derivative of 3,9-diethyltridecanol-6.

5. A method as described in claim 1 wherein the emulsifying agent is a sodium sulfate derivative of 7-ethyl-2-methyl-4-undecanol.

6. A method as described in claim 1 wherein the emulsifying agent is sodium lauryl sulfate.

7. A method as described in claim 1 wherein the emulsifying agent is hydrocarbon-sodium sulfonate dry cleaning soak.

8. A method as described in claim 1 wherein the water soluble N-methylol urea resin is present in the emulsion in amounts of about from 4% to 11% by weight.

9. A method as described in claim 1 wherein the chlorinated hydrocarbon solvent is present in the emulsion in amounts of about from 51% to 84% by weight.

* * * * *